US007806998B2

(12) United States Patent
Kang et al.

(10) Patent No.: US 7,806,998 B2
(45) Date of Patent: Oct. 5, 2010

(54) METHOD OF MANUFACTURING SUPER FORMABLE HIGH STRENGTH STEEL SHEET

(75) Inventors: Hee-Jae Kang, Pohang-si (KR); Sang-Ho Han, Pohang-si (KR)

(73) Assignee: Posco (KR)

( * ) Notice: Subject to any disclaimer, the term of this patent is extended or adjusted under 35 U.S.C. 154(b) by 266 days.

(21) Appl. No.: 12/016,241

(22) Filed: Jan. 18, 2008

(65) Prior Publication Data

US 2008/0210346 A1 Sep. 4, 2008

Related U.S. Application Data

(62) Division of application No. 10/494,202, filed as application No. PCT/KR03/01260 on Jun. 27, 2003, now abandoned.

(30) Foreign Application Priority Data

Jun. 28, 2002 (KR) ..... 2002-36625

(51) Int. Cl.
*C21D 8/00* (2006.01)
*C21D 8/04* (2006.01)

(52) U.S. Cl. ..... 148/603; 148/651; 148/505; 148/507

(58) Field of Classification Search ..... 148/603, 148/651, 505, 507
See application file for complete search history.

(56) References Cited

U.S. PATENT DOCUMENTS

| | | | |
|---|---|---|---|
| 4,504,326 | A | 3/1985 | Tokunaga et al. |
| 5,360,493 | A | 11/1994 | Matsuoka et al. |
| 5,690,755 | A | 11/1997 | Yoshinaga et al. |
| 6,316,127 | B1 | 11/2001 | Ikeda et al. |
| 6,410,163 | B1 | 6/2002 | Suzuki et al. |
| 6,652,670 | B2 | 11/2003 | Inoue et al. |
| 6,663,725 | B2 | 12/2003 | Inoue et al. |
| 6,743,306 | B2 | 6/2004 | Nakajima et al. |

FOREIGN PATENT DOCUMENTS

| | | | |
|---|---|---|---|
| JP | 63-243226 | * | 10/1988 |
| JP | 2173242 | A | 7/1990 |
| JP | 5009587 | A | 1/1993 |
| JP | 5263185 | A | 1/1993 |
| JP | 5230541 | A | 9/1993 |
| KR | 20020047573 | A | 6/2002 |
| WO | 0018976 | A1 | 4/2000 |
| WO | 0120051 | A1 | 3/2001 |
| WO | 0123624 | A1 | 4/2001 |
| WO | 0198552 | A1 | 12/2001 |

* cited by examiner

*Primary Examiner*—Deborah Yee
(74) *Attorney, Agent, or Firm*—The Webb Law Firm

(57) ABSTRACT

A super formable high strength thin steel sheet suitable for use in various applications, e.g., automobiles, and a method for manufacturing the thin steel sheet. The thin steel sheet has a composition which comprises 0.010 wt % or less of C, 0.02 wt % or less of Si, 1.5 wt % or less of Mn, 0.03-0.15 wt % or less of P, 0.02 wt % or less of S, 0.03-0.40 wt % of Sol. Al, 0.004 wt % or less of N, 0.005-0.040 wt % of Ti, 0.002-0.020 wt % of Nb, one or both of 0.001-0.02 wt % of B and 0.005-0.02 wt % of Mo, and the balance of Fe and inevitable impurities, wherein the components P, Mn, Ti, Nb and B satisfy the relationship represented by the following Formulae 1-1 and 1-2, depending on a desired tensile strength: Formula 1-1—tensile strength: 35 kg and 40 kg grades 29.1+89.4P(%)+3.9Mn(%)−133.8Ti(%)+157.5Nb(%)+0.18[B(ppm) or Mo(%)] 15=3544.9 Formula 1-2—tensile strength: 45 kg grade 29.1+98.3P(%)+4.6 Mn(%)86.5Ti(%)62.5Nb(%)+0.21 [B(ppm) or Mo(%)]—4550, the components Ti, N, C and Nb satisfy the relationship represented by the following Formula 2: $0.6 \leqq (1/0.65)(Ti-3.43N)/4C \leqq 3.5$, and Formula 3: $0.4 \leqq (1/0.35)(Nb/7.75C) \leqq 2.2$.

1 Claim, 7 Drawing Sheets

METHOD OF MANUFACTURING SUPER FORMABLE HIGH STRENGTH STEEL SHEET

CROSS REFERENCE TO RELATED APPLICATIONS

This application is a division of U.S. patent application Ser. No. 10/494,202 filed Apr. 29, 2004, now abandoned entitled "Super Formable High Strength Steel Sheet and Method of Manufacturing Thereof" which is incorporated herein by reference in its entirety, which is the national phase of PCT/KR03/01260 filed Jun. 27, 2003.

BACKGROUND OF THE INVENTION

1. Field of the Invention

The present invention relates to a super formable high strength thin steel sheet suitable for use in various applications, e.g., automobiles, and a method for manufacturing the thin steel sheet. More particularly, the present invention relates to a thin steel sheet with excellent workability and low-temperature annealing properties as a Ti—Nb-containing steel in which coarse Ti-based or Nb-based precipitates are distributed, and a method for manufacturing the thin steel sheet. The thin steel sheet is subjected to surface treatment and has excellent powdering resistance.

2. Description of Related Art

In recent years, steel sheets for automobiles tend to be shaped into an integral body due to their complicated configurations. A high level of formability is required to satisfy this tendency. At the same time, high strength of steel sheets is also required to reduce the weight of car bodies and to ensure safety of drivers. Accordingly, studies on steel sheets having a high strength and high r-value (Lankford value) are thus being actively undertaken.

Some cold rolled steel sheets for automobiles having a tensile strength of 35 kgf/mm$^2$ grade or more and an r-value of 2.0 or more are disclosed in (1) Japanese Patent Laid-Open No. 5-230541, (2) U.S. Pat. No. 5,360,493 and (3) Korean Patent Laid-Open No. 2002-0047573.

(1) According to Japanese Patent Laid-Open No. 5-230541, a steel sheet for automobiles is manufactured by subjecting a steel slab to lubrication hot rolling at a temperature between the $Ar_3$ transformation point and 500° C., and recrystallizing, cold rolling and continuously annealing the resulting steel slab, the steel slab comprising a Ti—Nb-containing ultra-low carbon steel with 0.2 wt % or less of Al as a deoxidizing element.

(2) According to U.S. Pat. No. 5,360,493, a steel sheet for automobiles is manufactured by subjecting a steel slab to lubrication hot rolling at a temperature between the $Ar_3$ transformation point and 500° C., and recrystallizing, cold rolling and continuously annealing the resulting steel slab, the steel slab comprising a Nb-containing low carbon steel with 0.2 wt % or less of Al as an element for precipitating and fixing AlN.

Subsequent to the above-referenced prior art (1) and (2), however, techniques have been developed in which the steel sheets are manufactured by lubrication rolling in the ferrite zone, such that the steel sheets cannot be manufactured by common hot rolling equipments. In addition, the referenced prior art has disadvantages such that recrystallization annealing must be carried out before cold rolling and continuous annealing temperature is as high as 890° C.

(3) Korean Patent Laid-Open No. 2002-0047573, which was filed by the present inventors, relates to a method for manufacturing a cold rolled steel sheet which comprises a Ti—Nb-containing ultra-low carbon steel with 0.15 wt % or less of Al as a deoxidizing element. The cold rolled steel sheet has a high tensile strength of 40 kgf/mm$^2$ grade or more and a high r-value of 2.0 or more without involving recrystallization of a hot rolled sheet, and at the same time, excellent formability. The method lowers the continuous annealing temperature to 830° C., but there is a need to further lower it.

In the prior art (1), (2) and (3) discussed above, since a galvanizing or galvannealing process is applied to the cold rolled steel sheets, powdering resistance of the galvanized layer is an important factor. However, the cited prior art fails to mention the powdering resistance.

SUMMARY OF THE INVENTION

Therefore, the present invention overcomes the above problems, by providing a high strength thin steel sheet which can be continuously annealed even at low temperature and which has excellent workability and excellent powdering resistance of a plated layer.

In addition, the present invention provides a method for manufacturing the high strength steel sheet.

In accordance with the present invention, there is provided a cold rolled steel sheet having a composition which comprises 0.010 wt % or less of C, 0.02 wt % or less of Si, 1.5 wt % or less of Mn, 0.03-0.15 wt % or less of P, 0.02 wt % or less of S, 0.03-0.40 wt % of Sol. Al, 0.004 wt % or less of N, 0.005-0.040 wt % of Ti, 0.002-0.020 wt % of Nb, one or both of 0.0001-0.02 wt % of B and 0.005-0.02 wt % of Mo, and the balance of Fe and inevitable impurities, wherein the components P, Mn, Ti, Nb and B satisfy the relationship represented by the following Formulae 1-1 and 1-2, depending on a desired tensile strength:

tensile strength:35 kg and 40 kg grades $$29.1+89.4P(\%)+3.9Mn(\%)-133.8Ti(\%)+157.5Nb(\%)+0.18[B(ppm)\text{ or }Mo(\%)]=35\text{-}44.9 \quad \text{Formula 1-1}$$

tensile strength: 45 kg grade $$29.1+98.3P(\%)+4.6Mn(\%)-86.5Ti(\%)+62.5Nb(\%)+0.21[B(ppm)\text{ or }Mo(\%)]=45\text{-}50, \quad \text{Formula 1-2}$$

the components Ti, N, C and Nb satisfy the relationship represented by the following Formulae 2 and 3:

$$0.6 \leqq (1/0.65)(Ti-3.43N)/4C \leqq 3.5 \quad \text{Formula 2}$$

$$0.4 \leqq (1/0.35)(Nb/7.75C) \leqq 2.2, \quad \text{Formula 3}$$

and Ti-based and Nb-based precipitates are distributed in an average size ranging from 30-60 nm.

In accordance with one aspect of the present invention, there is provided a galvanized steel sheet having a composition which comprises 0.010 wt % or less of C, 0.02 wt % or less of Si, 1.5 wt % or less of Mn, 0.03-0.15 wt % or less of P, 0.02 wt % or less of S, 0.03-0.40 wt % of Sol. Al, 0.004 wt % or less of N, 0.005-0.040 wt % of Ti, 0.002-0.020 wt % of Nb, one or both of 0.0001-0.02 wt % of B and 0.005-0.02 wt % of Mo, and the balance of Fe and inevitable impurities, wherein the components P, Mn, Ti, Nb and B satisfy the relationship represented by the following Formulae 1-1 and 1-2, depending on a desired tensile strength:

tensile strength:35 kg and 40 kg grades $$29.1+89.4P(\%)+3.9Mn(\%)-133.8Ti(\%)+157.5Nb(\%)+0.18[B(ppm)\text{ or }Mo(\%)]=35\text{-}44.9 \quad \text{Formula 1-1}$$

tensile strength: 45 kg grade $$29.1+98.3P(\%)+4.6Mn(\%)-86.5Ti(\%)+62.5Nb(\%)+0.21[B(ppm) \text{ or } Mo(\%)]=45\text{-}50, \quad \text{Formula 1-2}$$

the components Ti, N, C and Nb satisfy the relationship represented by the following Formulae 2 and 3:

$$0.6 \leqq (1/0.65)(Ti-3.43N)/4C \leqq 3.5 \quad \text{Formula 2}$$

$$0.4 \leqq (1/0.35)(Nb/7.75C) \leqq 2.2, \quad \text{Formula 3}$$

Ti-based and Nb-based precipitates are distributed in an average size ranging from 30-60 nm, the steel sheet has a galvanized layer formed on its surface, and the content of Al in the steel sheet is not less than that calculated from the following formula: weight loss in the plated layer=0.0642 Ln (content of sol. Al (%) in the steel)−0.0534.

In accordance with another aspect of the present invention, there is provided a method for manufacturing a cold rolled steel sheet, comprising the steps of:

finish hot rolling a steel slab having a composition of 0.010 wt % or less of C, 0.02 wt % or less of Si, 1.5 wt % or less of Mn, 0.03-0.15 wt % or less of P, 0.02 wt % or less of S, 0.03-0.40 wt % of Sol. Al, 0.004 wt % or less of N, 0.005-0.040 wt % of Ti, 0.002-0.020 wt % of Nb, one or both of 0.0001-0.02 wt % of B and 0.005-0.02 wt % of Mo, and the balance of Fe and inevitable impurities at the austenite monophase zone, wherein the components P, Mn, Ti, Nb and B satisfy the relationship represented by the following Formulae 1-1 and 1-2, depending on a desired tensile strength:

tensile strength:35 kg and 40 kg grades $$29.1+89.4P(\%)+3.9Mn(\%)-133.8Ti(\%)+157.5Nb(\%)+0.18[B(ppm) \text{ or } Mo(\%)]=35\text{-}44.9 \quad \text{Formula 1-1}$$

tensile strength: 45 kg grade $$29.1+98.3P(\%)+4.6Mn(\%)-86.5Ti(\%)+62.5Nb(\%)+0.21[B(ppm) \text{ or } Mo(\%)]=45\text{-}50, \quad \text{Formula 1-2}$$

the components Ti, N, C and Nb satisfy the relationship represented by the following Formulae 2 and 3:

$$0.6 \leqq (1/0.65)(Ti-3.43N)/4C \leqq 3.5 \quad \text{Formula 2}$$

$$0.4 \leqq (1/0.35)(Nb/7.75C) \leqq 2.2; \quad \text{Formula 3}$$

coiling the resulting hot rolled steel slab at a temperature meeting the following condition:

$730\sqrt{(1-(Ti^*/0.027)^2)}\pm 15°$ C. [in which $Ti^*=Ti(\%)-3.43N(\%)$] to provide a hot rolled coil;

cold rolling the hot rolled coil to provide a cold rolled coil; and continuously annealing the cold rolled coil at 780-830° C.

BRIEF DESCRIPTION OF THE DRAWINGS

The above and other objects, features and other advantages of the present invention will be more clearly understood from the following detailed description taken in conjunction with the accompanying drawings, in which:

(FIG. 1A: 0.05% (annealing recrystallization finish temperature: 830° C., and FIG. 1B: 0.16% (annealing recrystallization finish temperature: 800° C.)) in a steel on the precipitation of a cold rolled steel sheet;

DETAILED DESCRIPTION OF THE INVENTION

The thin steel sheet used herein includes cold rolled steel sheets and surface-treated steel sheets such as galvanized steel sheets. The galvanized steel sheets include galvannealed steel sheets. The tensile strength of 35 kg grade refers to a tensile strength range from 35-39.9 kgf/mm$^2$, and the tensile strength of 40 kg grade refers to a tensile strength ranging from 40-44.9 kgf/mm$^2$, and the tensile strength of 45 kg grade refers to a tensile strength ranging from 45-49.9 kgf/mm$^2$.

The present inventors intend to improve the properties of the cold rolled steel sheet disclosed in Korean Patent Laid-Open No. 2002-0047573, which was filed by the present inventors. Like other prior art, Al is used as a deoxidizing element in a Ti—Nb-containing steel in Korean Patent Laid-Open No. 2002-0047573 and Japanese Patent Laid-Open No. 5-230541. On the contrary, in U.S. Pat. No. 5,360,493, Al is considered as an element for precipitating and fixing dissolved N.

The present inventors have paid special attention to novel functions of Al which has been considered as a deoxidizing element, particularly in connection with precipitates, thus accomplishing the present invention.

First, Al contained in a Ti—Nb-containing steel acts as a driving force for the formation of coarse Ti-based or Nb-based precipitates, thus significantly increasing the r-value.

For better workability, the formation of FeTiP precipitates is prevented, and fine Ti-based and Nb-based precipitates (TiC, NbC, TiS, $Ti_4C_2S_2$) become coarser by a few nm.

Figure 1A:
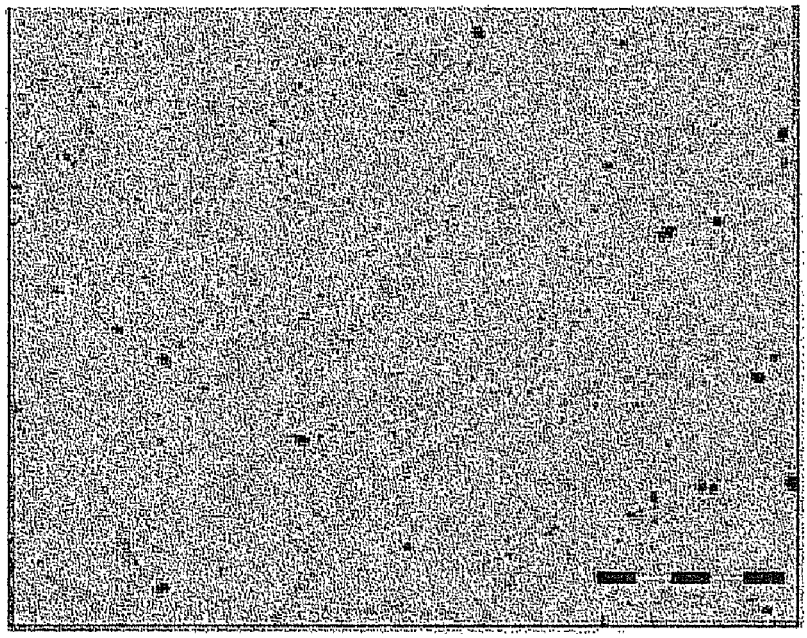
FIGS. 1A and 1B are electron microscope images showing the influence of Al content
Figure 1B:
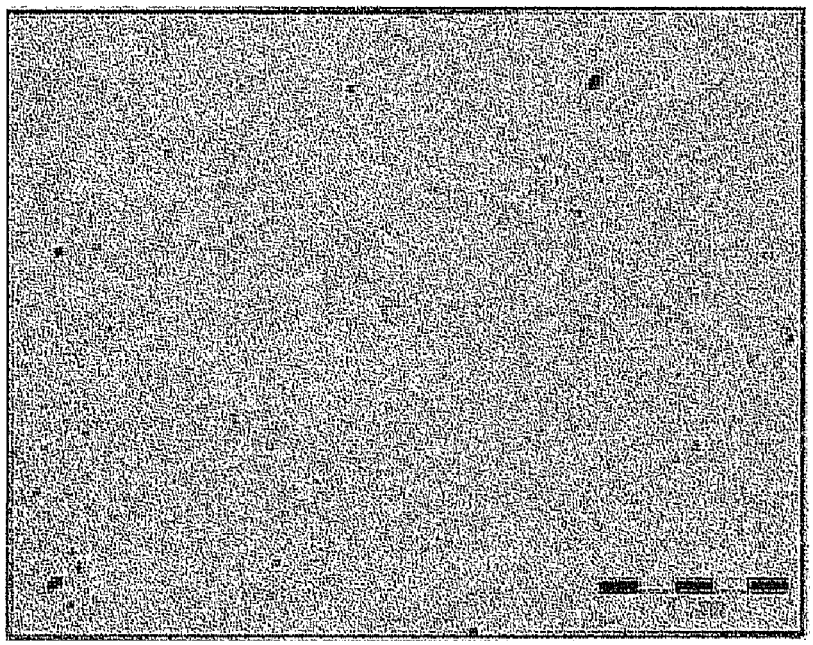

According to the present invention, the Ti-based and Nb-based precipitates are coarsely formed to be 30-60 nm in size, thus improving workability. Factors affecting the formation of coarse Ti-based and Nb-based precipitates and size thereof are Al content and coiling conditions. The addition of Al reduces the distribution of the Ti-based and Nb-based precipitates and makes the size of the Ti-based and Nb-based precipitates coarse. At this time, coiling temperature conclusively affects the formation of the precipitates. The amount of effective Ti (hereinafter referred to as 'Ti*') remaining after bonding with nitrogen in the steel acts as a driving force for the precipitation of FeTiP or TiC. Accordingly, appropriate control of coiling temperature depending on the amount of Ti* can induce the precipitation of TiC, instead of FeTiP. At this time, the size of the TiC precipitates depends on the Al content. FIGS. 1A and 1B are electron microscope images of a low-Al steel and a high-Al steel. As shown in FIGS. 1A and 1B, as the distribution of precipitates in the high-Al steel decreases, the size of the precipitates increases. Surprisingly, it was found that the Al content and coiling conditions can reduce the distribution of the precipitates and make the size of the precipitates coarse.

The effects of the Al content and the coiling conditions on the distribution of the precipitates and the size thereof in the Ti—Nb-containing steel can be determined by the r-value.

Figure 2:
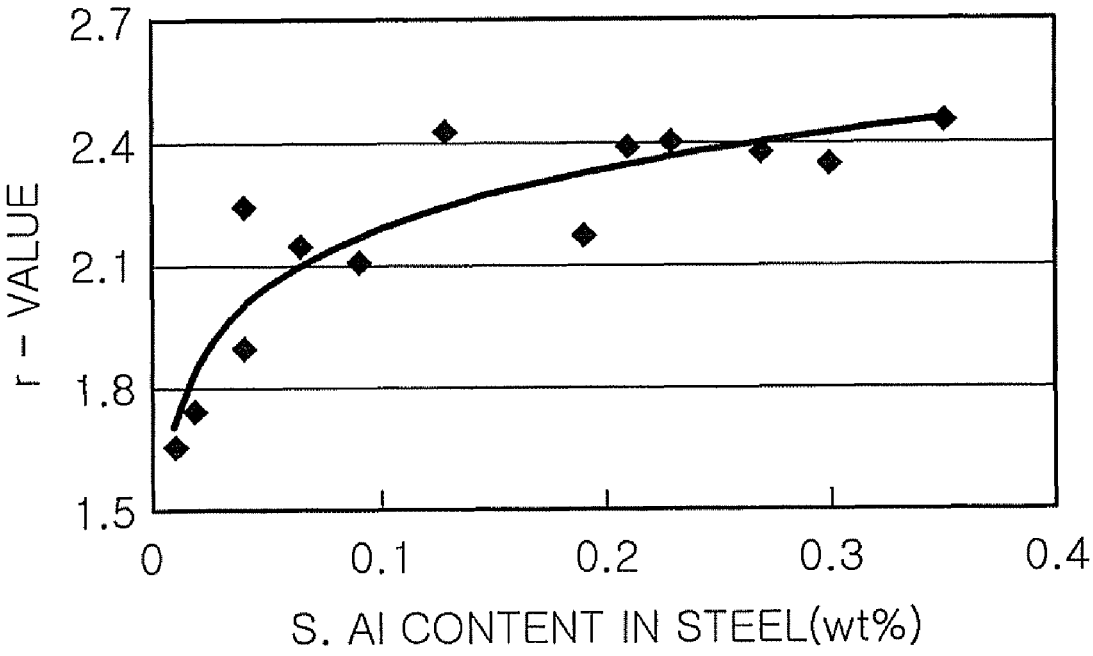
FIG. 2 is a graph showing the influence of Al content in a steel on the r-value of a cold rolled steel sheet.

As shown in FIG. 2, the higher the Al content in the Ti—Nb-containing steel is, the higher the r-value is. When the Al content is not less than 0.151%, particularly 0.21%, the r-value is greatly improved.

Second, Al lowers the continuous annealing temperature of the Ti—Nb-containing steel.

P is added to the Ti—Nb-containing steel to increase the strength, and prevents recrystallization.

When Al is contained in an amount not less than 0.151%, particularly 0.21%, it impedes the prevention of recrystallization due to P and promotes the recrystallization, thereby lowering the continuous annealing temperature. In addition, since coarse precipitates are distributed in the steel of the present invention, annealing recrystallization delay resulting from fine precipitates can be prevented.

Figure 3:
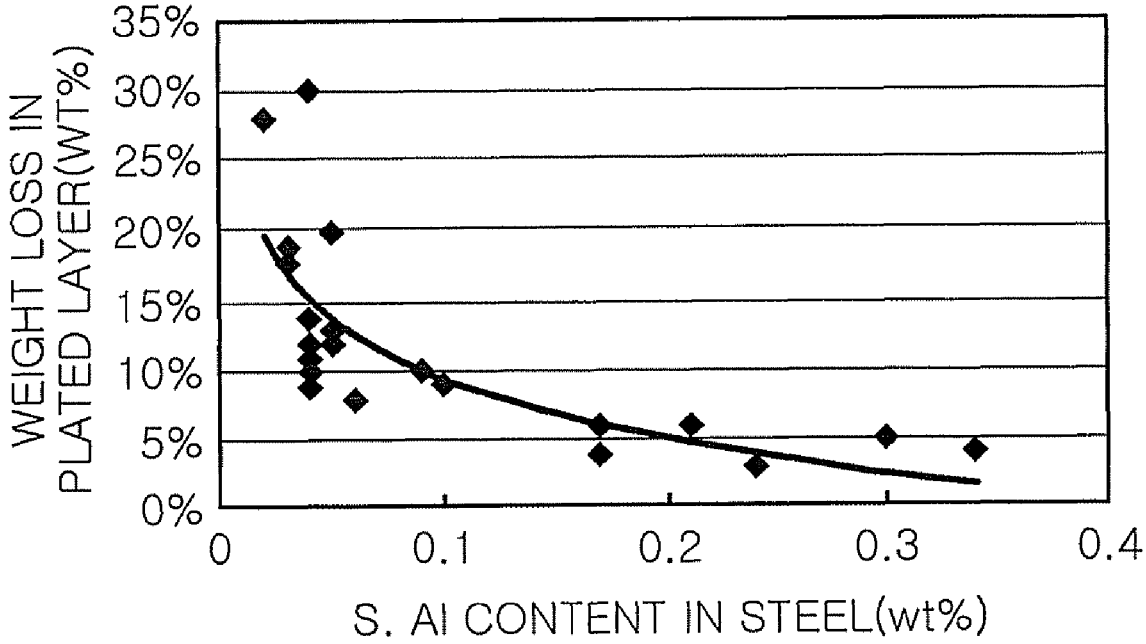
FIG. 3 is a graph showing the influence of Al content in a steel on the powdering resistance (weight loss in a galvanized layer) of a galvanized steel sheet.

Third, Al improves the powdering resistance of the Ti—Nb-containing steel. It was found that Al diffuses into a surface layer along a grain boundary upon plating and makes the plated layer compact, thereby improving the powdering resistance. As shown in FIG. 3, there is a relationship between the Al content and the powdering resistance in the Ti—Nb-containing steel. Based on the relationship, appropriate control of the Al content enables improvement of the powdering resistance. That is, when the Al content in the steel sheet is higher than that obtained by the following formula, excellent powdering resistance can be attained: weight loss in the plated layer=−0.0642 Ln (content of sol. Al (%) in the steel)−0.0534.

As described above, the present invention is attributable to the fact that the workability of the Ti—Nb-containing steel can be improved by the coarse Ti-based or Nb-based precipitates. The reason for limiting the content range of each component will be explained below.

C:0.01% or Less

C contained in the steel is an interstitial dissolved element and prevents the formation of a {111} texture helpful for the workability. Accordingly, it is preferred to limit the content of C in the steel to 0.01% or less. As the C content increases, the amount of Ti and Nb, carbonitride-forming elements, increases, which is economically disadvantageous. More preferably, the C content is limited to 0.005% or less.

Si: 0.02/% or Less

Si contained in the steel causes scale defects on the surface, and generates a temper color upon annealing and non-plated regions upon plating. Accordingly, it is preferred to limit the content of Si in the steel to 0.02% or less.

Mn: 1.5% or Less

Mn contained in the steel is a substitutional solid solution strengthening element, and is added for strength improvement. When the Mn content exceeds 1.5%, elongation and r-value are drastically decreased. Accordingly, it is preferred to limit the content of Mn in the steel to 1.5% or less.

P: 0.03-0.15%

Like Mn, P contained in the steel is a solid solution strengthening element. P increases the strength of the Ti—Nb-based steel grades of the steel of the present invention, and develops a {111} texture helpful to increase the r-value due to fine graining and boundary segregation, etc. When the P content exceeds 0.15%, elongation is considerably reduced and the embrittlement of the steel is greatly increased. Accordingly, it is preferred to limit the content of P in the steel to 0.03-0.15%.

S: 0.02% or Less

As the S content is further lowered, it is more advantageous in terms of the workability of the steel sheet. Accordingly, the S content is commonly maintained at a level of 0.005% or lower. Since Mn in the steel is bonded to S to form MnS, the deterioration of workability due to dissolved S can be avoided. Accordingly, it is preferred to limit the content of S in the steel to 0.02% or less in which the occurrence of edge cracks can be avoided.

Sol. Al: 0.03-0.40%

Sol. Al is the most important element in the present invention, and impedes the prevention of recrystallization due to P, thereby promoting recrystallization. Sol. Al diffuses into a surface layer along a grain boundary upon plating and makes the plated layer compact, thereby improving the powdering resistance. The addition of Al reduces the distribution of the Ti-based and Nb-based precipitates (TiC, NbC, TiS, $Ti_4C_2S_2$) and makes the size of the Ti-based and Nb-based precipitates coarse, thereby increasing the r-value. These functions of Sol. Al are possible only when the Sol. Al content is 0.03% or more, preferably 0.151% or more, and more preferably 0.21% or more. When the Sol. Al content is higher than 0.4%, considerable cost is taken and operating efficiency for continuous casting is deteriorated.

N: 0.004% or Less

Too high N content causes deteriorated workability. As the N content increases, the Ti content is undesirably increased. Accordingly, it is preferred to limit the content of N in the steel to 0.004% or less, if possible.

Ti: 0.005-0.040% Nb: 0.002-0.020%

Ti and Nb are important elements in terms of workability (particularly, r-value). For improved workability, Ti and Nb are preferably added in an amount of 0.005% or more and 0.002% or more, respectively. The Ti content and the Nb content exceeding 0.040% and 0.020%, respectively, are economically disadvantageous. Accordingly, it is preferred to limit the content of Ti and Nb to 0.005-0.04% and 0.002-0.020%, respectively.

One or Both of 0.0001-0.02 wt % of B and 0.005-0.02 wt % of Mo

B and Mo contained in the steel are elements useful for preventing P from embrittling the grain boundaries and prevent a second working embrittlement. If a mixture of B and Mo is added, there is a risk of low r-value and increased cost. Accordingly, one element selected from B and Mo is preferably added. Considering that exact control of the amount of B is difficult, the addition of Mo is more preferable. In the present invention, the amounts of B and Mo added for a second working embrittlement are 0.0001% or more and 0.005% or more, respectively. When the amounts of B or Mo added are more than 0.002% and 0.02%, respectively, workability is considerably reduced.

In order to attain a desired strength and a high r-value of the Ti—Nb-containing steel according to the present invention, the Ti—Nb-containing steel must meet the following formulae 1 to 3.

Formulae 1-1 and 1-2 are equations which are regressively obtained from empirical equations expressed by numerically representing the influence of each component on the tensile strength. Formulae 1-1 and 1-2 are based on the fact that Ti and Nb other than P, Mn and B may affect the strength of the steel. Ti promotes the precipitation of FeTiP and thus reduces the strengthening effect of P, a solid solution strengthening element. In addition, Nb is self-dissolved and thus increases the strength of the steel.

The elements P, Mn, Ti, Nb and B are preferably added so as to satisfy the relationship represented by the following formula 1-1 or 1-2 depending on a desired strength. Formula 1-1 is applied to 35 kg and 40 kg grades, and Formula 1-2 is applied to a 45 kg grade.

$$29.1+89.4P(\%)+3.9Mn(\%)-133.8Ti(\%)+157.5Nb(\%)+0.18(B(ppm)\text{ or }Mo(\%))=35\text{-}44.9 \quad \text{Formula 1-1}$$

$$29.1+98.3P(\%)+4.6Mn(\%)-86.5Ti(\%)+62.5Nb(\%)+0.21(B\text{ or }Mo)(ppm)=45\text{-}50 \quad \text{Formula 1-2}$$

Figure 4:
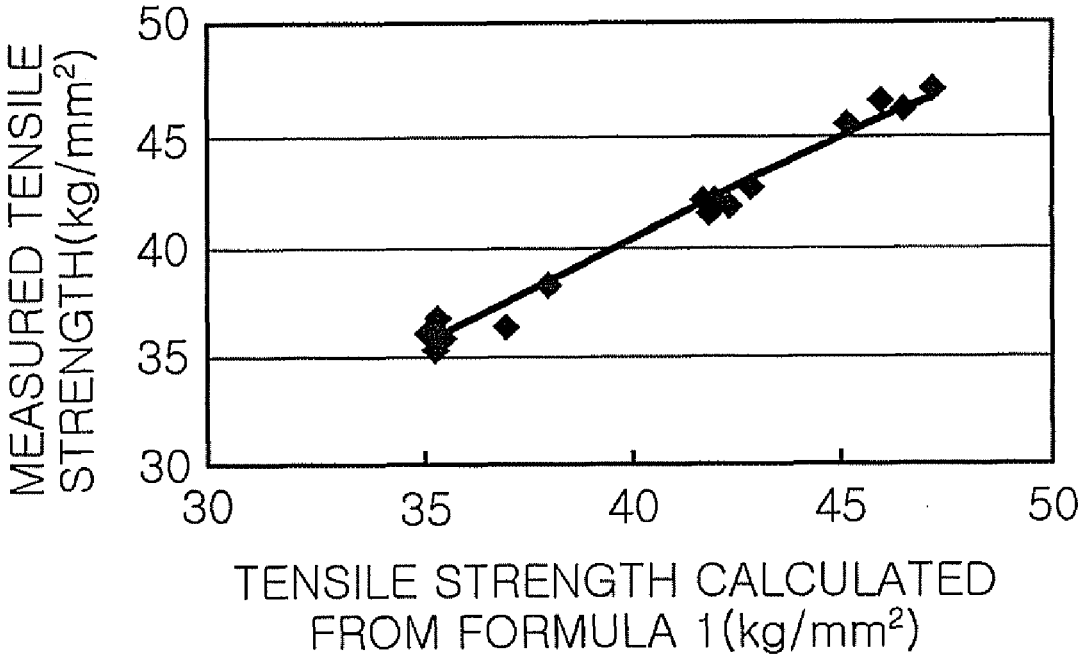
FIG. 4 is a graph showing the influence of P, Mn, Ti, Nb and B contents on the tensile strength of a cold rolled steel sheet.

As can be seen from FIG. 4, values (tensile strength) calculated by Formulae 1-1 and 1-2 depending on the contents of P, Mn, Ti, Nb and B are substantially coincident with measured values. Accordingly, the present invention has an advantage in that a desired grade (tensile strength) of a cold rolled steel sheet can be freely designed within the range of 35-50 kg/mm$^2$. In FIG. 4, 35 kg and 40 kg grades are given by Formula 1-1, and a 45 kg grade is given by Formula 1-2.

Figure 5:
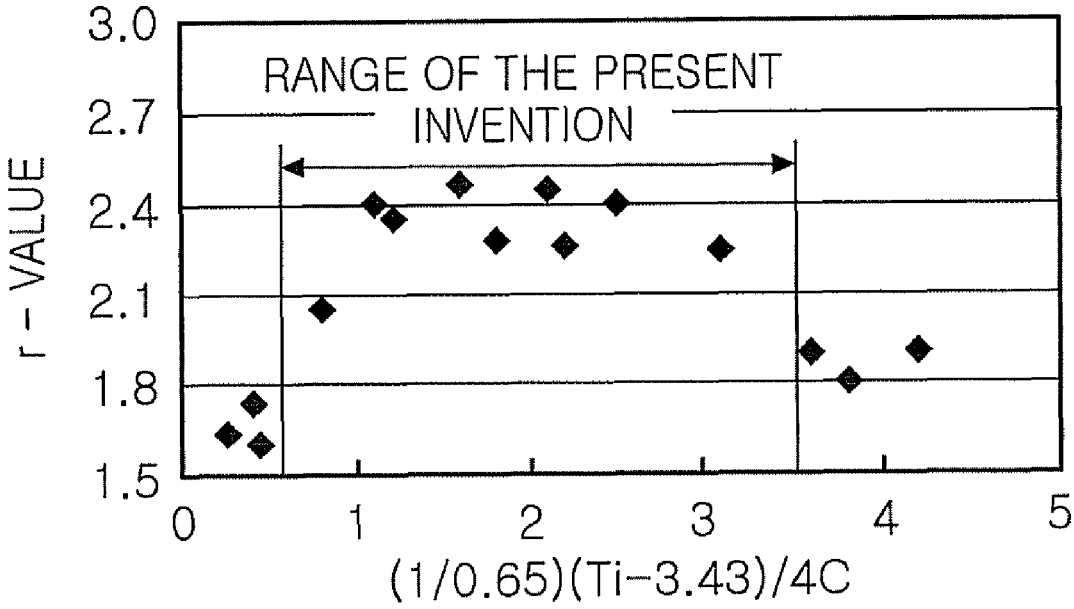
FIG. 5 is a graph showing the influence of Ti, N and C contents on the r-value of a cold rolled steel sheet.
Figure 6:
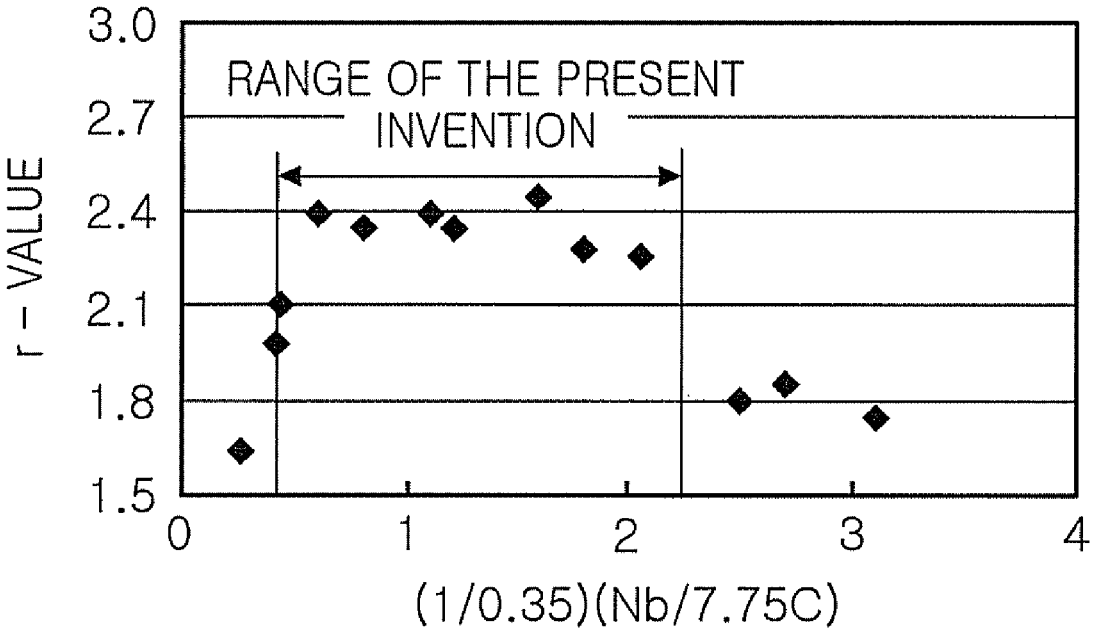
FIG. 6 is a graph showing the influence of Nb and C contents on the r-value of a cold rolled steel sheet.

When the contents of Ti and Nb, carbonitride-forming elements, in the Ti—Nb-containing steel satisfy the relationship represented by the following formulae 2 and 3, workability can be improved. That is, as can be seen from FIGS. 5 and 6, r-values are dependent on Formulae 2 and 3 below:

$$0.6 \leqq (1/0.65)(Ti-3.43N)/4C \leqq 3.5 \quad \text{Formula 2}$$

$$0.4 \leqq (1/0.35)(Nb/7.75C) \leqq 2.2 \quad \text{Formula 3}$$

Formula 2 defines the amount of Ti added. When the atomic equivalence ratio between 65% [=(1/0.65)(Ti−3.43N)] of the amount remaining after Ti equivalently bonds with dissolved N, and dissolved carbon in the steel is less than 0.6, the fixation of the dissolved carbon is unstable and the r-value is decreased. When the atomic equivalence ratio exceeds 3.5, the remaining amount of Ti is too large and thus a large amount of FeTiP precipitates is formed, decreasing the r-value. Formula 2 preferably optimizes the amount of Ti added for improved workability. An experimental result demonstrates that 65% of the amount remaining after Ti equivalently bonds with dissolved N bonds with dissolved C. That is, since most of the carbon precipitates are in the form of (Ti, Nb)C, the measurement of the content ratio of Ti to Nb, which participates in the fixation of the dissolved carbon, demonstrates that the ratio is 65%:35%.

In addition, Formula 3 defines the amount of Nb added. When the ratio of the Nb content in the steel to dissolved carbon is less than 0.4, incomplete scavenging may be increased. When the ratio exceeds 2.2, the amount of dissolved Nb in the steel increases, causing poor workability. Accordingly, the amount of Nb added for excellent workability is preferably optimized by the Formulae expressed above.

The Ti-based and Nb-based precipitates are distributed in an average size ranging from 30-60 mn in the Ti—Nb-containing steel of the present invention. When the average size of the precipitates is smaller than 30 nm, workability is poor. The coarser the precipitates are, the better the workability is. However, when the average size of the precipitates is larger than 60 nm, the amount of FeTiP adversely affecting the workability is undesirably increased. That is, in order to obtain precipitates having a size of 60 nm or larger, high coiling temperature is required. It was identified in the present invention that increase of coiling temperature leads to more FeTiP precipitates. Accordingly, the upper limit of the size of the coarse precipitates capable of preventing the precipitation of FeTiP was proved to be 60 nm.

A galvanized layer is formed on the surface of the cold rolled steel sheet according to the present invention. At this time, the Al content in the cold rolled steel sheet influences the powdering resistance of the galvanized layer. The following formula is regressively obtained from the relationship between the weight loss in the plated layer (upon powdering evaluation) and the content of Al in the steel sheet: Weight loss in the plated layer=−0.0642 Ln (content of sol. Al (%) in the steel)−0.0534.

A galvanized steel sheet having a weight loss in a plated layer less than a reference can be manufactured in accordance with the following procedure: After a reference weight loss in a plated layer is determined, it is applied to the formula described above to calculate the Al content in the steel sheet. Next, Al is added in an amount higher than the calculated Al content to manufacture a galvanized steel sheet having a weight loss less than the reference.

Next, the method of the present invention will be explained.

Hot Rolling Process

The steel slab thus manufactured is reheated, and then hot rolled under finish rolling conditions at an $Ar_3$ transformation point. The $Ar_3$ transformation point in the Ti—Nb-containing steel of the present invention is about 900° C. When the finish rolling temperature is in a diphase zone at a temperature not higher than the $Ar_3$ transformation point, a texture adversely affecting the r-value is undesirably developed.

Subsequently, the hot rolled steel sheet is coiled.

The coiling temperature (CT) must meet the following Formula 4:

$$CT=730\sqrt{(1-(Ti^*/0.027)2)}\pm 15^\circ\text{ C.} \quad \text{Formula 4}$$

wherein, Ti* represents Ti(%)−3.43N(%).

Ti* refers to the amount of effective Ti remaining after bonding with nitrogen in the steel. Accordingly, in the case that the amount of effective Ti is relatively large, there is a large possibility that FeTiP adversely affecting the workability may be precipitated. To prevent the precipitation of FeTiP, low temperature coiling is preferably carried out. In the case that the amount of effective Ti is relatively small, the fixation of dissolved carbon into the form of TiC precipitates is required to attain a high r-value. For this purpose, high temperature coiling is preferably carried out. Formula 4 is an empirical expression obtained in view of the driving force of the formation of coarse precipitates depending on the amount of effective Ti.

Figure 7:
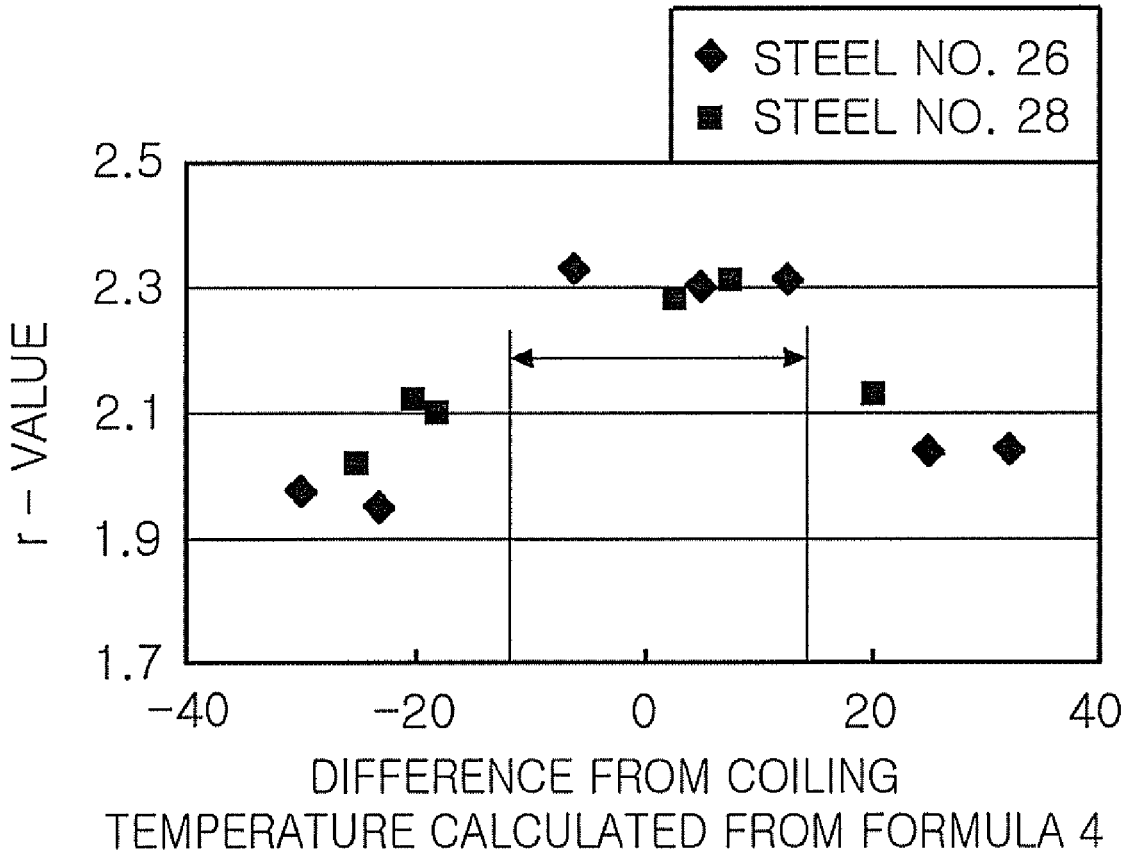
FIG. 7 is a graph showing the influence of coiling temperature on the r-value of a cold rolled steel sheet.

As can be seen from FIG. 7, the coiling temperature is dependent on Formula 4. As shown in FIG. 7, the r-value is good within the range of the coiling temperature calculated by Formula 4±15° C.

Cold Rolling Process

The hot rolled steel sheet thus coiled is cold rolled.

To attain a high r-value, the cold rolling is preferably carried out at a cold rolling reduction rate of 70% or more. More preferably, the cold rolling is carried out at a cold rolling reduction rate of 70-90%.

Continuous Annealing Process

The cold rolled steel sheet thus cold rolled is annealed.

The annealing is preferably continuously carried out. The annealing temperature is preferably within the range of 780-860° C. When the annealing temperature is lower than 780° C., it is almost impossible to obtain an r-value of 2.0 or more. When the annealing temperature is higher than 860° C., there may be a problem in the shape of a strip due to high temperature annealing during processing. When the Al content in the Ti—Nb-containing steel of the present invention is not lower than 0.151% or 0.21%, the annealing temperature can be lowered to 830° C. or less. The annealing temperature is preferably carried out at 780-830° C.

After the continuous annealing, cooling is preferably carried out at a rate of 7-30° C./sec. For example, the cooling rate is preferably 15-30° C./sec in the case of a steel sheet having a tensile strength of 45 kg grade. When the cooling rate is less than 15° C./sec, it is difficult to obtain a tensile strength of 45 kg grade.

After the continuous annealing, skin pass rolling may be carried out at an appropriate reduction rate for controlling the shape or surface roughness. In addition, the cold rolled steel sheet of the present invention can be applied to original sheets of surface-treated steel sheets. Examples of the surface-treatment include galvanizing and galvannealing, etc. Galvanizing and, if necessary, galvannealing may be carried out following the continuous annealing.

Hereinafter, the present invention will be described in more detail with reference to the following Examples.

Formulae 1 to 4 shown in the Tables below are as follows:

tensile strength:35 kg and 40 kg grades $$29.1+89.4P(\%)+3.9Mn(\%)-133.8Ti(\%)+157.5Nb(\%)+0.18[B(ppm) \text{ or } Mo(\%)]=35-44.9 \quad \text{Formula 1-1}$$

tensile strength: 45 kg grade $$29.1+98.3P(\%)+4.6Mn(\%)-86.5Ti(\%)+62.5Nb(\%)+0.21[B(ppm) \text{ or } Mo(\%)]=45-50, \quad \text{Formula 1-2}$$

$$0.6 \leqq (1/0.65)(Ti-3.43N)/4C \leqq 3.5 \quad \text{Formula 2}$$

$$0.4 \leqq (1/0.35)(Nb/7.75C) \leqq 2.2 \quad \text{Formula 3}$$

$$730\sqrt{(1-(Ti^*/0.027)^2)} \pm 15° \text{ C. [in which } Ti^*=Ti(\%)-3.43N(\%)] \quad \text{Formula 4}$$

Example 1

After a steel slab shown in Table 1 below was hot rolled above an $Ar_3$ transformation point and coiled, the resulting coil was cold rolled and continuously annealed under the conditions shown in Table 2 below to manufacture a cold rolled steel sheet. The mechanical properties of the cold rolled steel sheet are shown in Table 2 below. As shown in Table 1, the content of both Si and S was 0.01%.

TABLE 1

| | Chemical components (wt %) | | | | | | | | Values calculated from Formulae | | | |
|---|---|---|---|---|---|---|---|---|---|---|---|---|
| Steel No. | C | Mn | P | S•Al | N | Ti | Nb | B (ppm) | Form 1 | Form. 2 | Form 3 | Remarks |
| 1 | 0.0027 | 0.5 | 0.04 | 0.05 | 0.0018 | 0.015 | 0.011 | 5 | 35.3 | 1.3 | 1.5 | Tensile |
| 2 | 0.0026 | 0.58 | 0.039 | 0.21 | 0.0027 | 0.017 | 0.01 | 7 | 35.4 | 1.1 | 1.4 | strength |
| 3 | 0.0032 | 0.6 | 0.042 | 0.04 | 0.0017 | 0.02 | 0.013 | 3 | 35.1 | 1.7 | 1.5 | 35 kg grade |
| 4 | 0.0029 | 0.53 | 0.042 | 0.30 | 0.0023 | 0.016 | 0.006 | 9 | 35.3 | 1.1 | 0.8 | (Formula 1-1 |
| 5 | 0.0038 | 0.48 | 0.061 | 0.03 | 0.0021 | 0.045 | — | 8 | — | — | — | application) |
| 6 | 0.0031 | 0.38 | 0.058 | 0.04 | 0.0029 | 0.048 | — | 5 | — | — | — | |
| 7 | 0.0027 | 0.880 | 0.110 | 0.06 | 0.0025 | 0.024 | 0.007 | 9 | 41.9 | 2.2 | 1.0 | Tensile |
| 8 | 0.0021 | 1.020 | 0.91 | 0.04 | 0.0023 | 0.016 | 0.010 | 10 | 42.4 | 1.5 | 1.8 | strength |
| 9 | 0.0031 | 0.780 | 0.102 | 0.17 | 0.002 | 0.021 | 0.013 | 8 | 41.9 | 1.8 | 1.5 | 40 kg grade |
| 10 | 0.0025 | 1.150 | 0.087 | 0.24 | 0.0026 | 0.018 | 0.006 | 12 | 42.1 | 1.4 | 0.9 | (Formula 1-1 |
| 11 | 0.0038 | 0.830 | 0.095 | 0.04 | 0.0028 | 0.043 | — | 7 | — | — | — | application) |
| 12 | 0.0033 | 0.950 | 0.105 | 0.03 | 0.0022 | 0.049 | — | 5 | — | — | — | |
| 13 | 0.0026 | 1.12 | 0.096 | 0.04 | 0.0026 | 0.016 | 0.007 | 8 | 45.1 | 1.0 | 1.0 | Tensile |
| 14 | 0.0031 | 1.09 | 0.094 | 0.05 | 0.0021 | 0.017 | 0.008 | 11 | 45.5 | 1.2 | 1.0 | strength |
| 15 | 0.0027 | 1.18 | 0.089 | 0.17 | 0.0028 | 0.019 | 0.006 | 12 | 45.1 | 1.3 | 0.8 | 45 kg grade |
| 16 | 0.0034 | 1.25 | 0.104 | 0.34 | 0.0031 | 0.023 | 0.01 | 7 | 46.2 | 1.4 | 1.1 | (Formula 1-2 |
| 17 | 0.0039 | 1.21 | 0.093 | 0.04 | 0.0025 | 0.052 | — | 6 | — | — | — | application) |
| 18 | 0.0032 | 1.24 | 0.095 | 0.05 | 0.0029 | 0.049 | — | 9 | — | — | — | |

TABLE 2

| Steel No. | Cold rolling reduction rate (%) | Continuous annealing temperature (° C.) | Tensile strength ($kg/mm^2$) | Elongation (%) | r-value | Powdering Resistance (Weight loss in plated layer) | Remarks |
|---|---|---|---|---|---|---|---|
| 1 | 73 | 843 | 35.2 | 43.2 | 2.34 | 12% | Tensile |
| 2 | 75 | 804 | 35.9 | 44.1 | 2.41 | 6% | Strength |
| 3 | 75 | 836 | 36.1 | 45.0 | 2.28 | 10% | 35 kg grade |
| 4 | 73 | 795 | 36.8 | 44.3 | 2.45 | 5% | |
| 5 | 75 | 830 | 35.8 | 45.2 | 1.89 | 18% | |
| 6 | 75 | 830 | 35.4 | 45.3 | 1.85 | 14% | |
| 7 | 75 | 835 | 42.1 | 35.9 | 2.21 | 8% | Tensile |
| 8 | 77.5 | 841 | 41.9 | 36.2 | 2.18 | 9% | Strength |
| 9 | 75 | 796 | 41.6 | 37.0 | 2.26 | 4% | 40 kg grade |
| 10 | 77.5 | 812 | 42.1 | 36.7 | 2.41 | 3% | |
| 11 | 75 | 830 | 41.2 | 37.2 | 1.82 | 9% | |
| 12 | 73 | 830 | 40.9 | 36.8 | 1.79 | 19% | |
| 13 | 75 | 843 | 45.5 | 33.9 | 2.18 | 11% | Tensile |
| 14 | 77.5 | 841 | 46.3 | 33.2 | 2.13 | 13% | Strength |
| 15 | 75 | 803 | 46.6 | 34.0 | 2.26 | 6% | 45 kg grade |
| 16 | 77.5 | 815 | 47.1 | 33.7 | 2.34 | 4% | |

TABLE 2-continued

| Steel No. | Cold rolling reduction rate (%) | Continuous annealing temperature (° C.) | Tensile strength (kg/mm$^2$) | Elongation (%) | r-value | Powdering Resistance (Weight loss in plated layer) | Remarks |
|---|---|---|---|---|---|---|---|
| 17 | 75 | 840 | 45.2 | 34.2 | 1.78 | 12% | |
| 18 | 73 | 830 | 45.9 | 33.8 | 1.75 | 20% | |

The r-values shown in Table 2 were measured by imparting a tensile pre-strain of 15%, and then averaging the values obtained at the L-direction (rolling direction), the D-direction (45° to the rolling direction) and the C-direction (90° to the rolling direction) as follows: r=(rL+2rD+rC)/4 in accordance with the three-point method. In addition, powdering resistance, that is, the weight loss in a plated layer was obtained by punching out a test piece in a disk having a radius of 100 mm, cupping at an elongation of 2.0 and weighing.

As shown in Tables 1 and 2, the steel sheet of the present invention can be freely designed into 35 kg, 40 kg, 45 kg grades, etc. In addition, the steel sheet of the present invention can have an r-value of 2.0 or more. Furthermore, upon powdering evaluation, the weight loss in a plated layer can be considerably reduced.

Example 2

After a steel slab shown in Table 3 below was hot rolled above an $Ar_3$ transformation point and coiled, the resulting coil was cold rolled at a cold rolling reduction rate of 77% and continuously annealed at 830° C. to manufacture a cold rolled steel sheet. The mechanical properties of the cold rolled steel sheet are shown in Table 4 below. As shown in Table 3, the content of both Si and S was 0.01%.

TABLE 3

| Steel | Chemical components (wt %) | | | | | | | | | Values measured from formulae | | | Hot rolling condition (° C.) | |
|---|---|---|---|---|---|---|---|---|---|---|---|---|---|---|
| No. | C | Mn | P | S•Al | N | Ti | Nb | Mo | B (ppm) | Form. 1 | Form. 2 | Form. 3 | FDT | CT |
| 19 | 0.0031 | 0.98 | 0.11 | 0.05 | 0.0025 | 0.024 | 0.007 | 0.007 | — | 40.6 | 1.9 | 0.8 | 913 | 587 |
| 20 | 0.0024 | 1.01 | 0.091 | 0.18 | 0.0023 | 0.016 | 0.01 | 0.012 | — | 40.6 | 1.3 | 1.5 | 910 | 638 |
| 21 | 0.0028 | 0.89 | 0.102 | 0.08 | 0.002 | 0.021 | 0.008 | 0.016 | — | 40.1 | 1.9 | 1.1 | 908 | 599 |
| 22 | 0.0025 | 1.05 | 0.095 | 0.23 | 0.0026 | 0.018 | 0.007 | — | — | 40.4 | 1.4 | 1.0 | 911 | 628 |
| 23 | 0.0038 | 0.93 | 0.095 | 0.05 | 0.0028 | 0.043 | 0.005 | — | 8 | — | — | — | 905 | 630 |
| 24 | 0.0033 | 0.95 | 0.105 | 0.04 | 0.0022 | 0.049 | 0.007 | — | 5 | — | — | — | 900 | 610 |

TABLE 4

| Steel No. | Ductile-brittle transition temperature (° C.) | Tensile properties: Tensile strength (kg/mm$^2$) | Elongation (%) | r-values |
|---|---|---|---|---|
| 19 | −40 | 41.1 | 35.0 | 2.17 |
| 20 | −45 | 41.8 | 36.1 | 2.18 |
| 21 | −40 | 41.0 | 36.8 | 2.09 |
| 22 | 5 | 42.1 | 36.7 | 2.18 |
| 23 | −40 | 41.2 | 37.6 | 2.06 |
| 24 | −45 | 40.9 | 36.9 | 2.08 |

Example 3

A steel slab shown in Table 5 below was finish hot rolled at 910° C. to obtain a hot rolled steel sheet. After the hot rolled steel sheet was coiled under the conditions shown in Table 6, the resulting coil was cold rolled at a cold rolling reduction rate of 77% and continuously annealed under the conditions shown in Table 7 below. The mechanical properties of the cold rolled steel sheet are shown in Table 6 below.

As shown in Table 5, the content of both Si and S was 0.01%.

TABLE 5

| Steel No. | Chemical components (wt %) | | | | | | | | | Values calculated from Formulae | | |
|---|---|---|---|---|---|---|---|---|---|---|---|---|
| | C | Mn | P | S•Al | N | Ti | Nb | B (ppm) | Ti* | Form. 1 | Form. 2 | Form. 3 |
| 25 | 0.025 | 0.92 | 0.11 | 0.05 | 0.0025 | 0.024 | 0.007 | 9 | 0.015 | 41.7 | 2.2 | 1 |
| 26 | 0.0031 | 1.01 | 0.096 | 0.06 | 0.0023 | 0.016 | 0.01 | 10 | 0.008 | 42.3 | 1.5 | 1.8 |
| 27 | 0.0022 | 0.78 | 0.104 | 0.07 | 0.002 | 0.021 | 0.013 | 8 | 0.014 | 41.9 | 1.8 | 1.5 |
| 28 | 0.0027 | 1.12 | 0.087 | 0.05 | 0.0026 | 0.018 | 0.006 | 12 | 0.009 | 42 | 1.4 | 0.9 |
| 29 | 0.0038 | 0.83 | 0.095 | 0.03 | 0.0028 | 0.043 | — | 7 | | — | — | — |

TABLE 5-continued

| Steel No. | Chemical components (wt %) C | Mn | P | S•Al | N | Ti | Nb | B (ppm) | Ti* | Values calculated from Formulae Form. 1 | Form. 2 | Form. 3 |
|---|---|---|---|---|---|---|---|---|---|---|---|---|
| 30 | 0.0033 | 0.95 | 0.105 | 0.04 | 0.0022 | 0.049 | — | 5 | | — | — | — |
| 31 | 0.0031 | 1.12 | 0.092 | 0.08 | 0.0024 | 0.017 | 0.008 | — (0.012 % Mo) | 0.009 | 40.7 | 1.1 | 1.0 |

Ti* is total amount of Ti - 3.43N (%)

TABLE 6

| Steel No. | Target CT calculated from Formula 4 | Coiling temperature (Measured value) | Annealing Temperature (° C.) | Tensile strength (kg/mm$^2$) | r-values |
|---|---|---|---|---|---|
| 25 | 599 ± 15° C. | 595 | 845 | 41.5 | 2.28 |
| 26 | 696 ± 15° C. | 690 | 840 | 41.3 | 2.33 |
| 27 | 621 ± 15° C. | 620 | 845 | 40.6 | 2.26 |
| 28 | 688 ± 15° C. | 680 | 850 | 42.1 | 2.31 |
| 28 | 688 ± 15° C. | 600 | 850 | 42.3 | 1.92 |
| 29 | — | 630 | 830 | 41.2 | 1.78 |
| 30 | — | 630 | 830 | 42.2 | 1.75 |
| 31 | 688 ± 15° C. | 685 | 838 | 41.1 | 2.26 |

$$730\sqrt{(1-(Ti^*/0.027)^2} \quad \text{Formula 4}$$

As can be seen from Table 6, if a steel sheet is manufactured by coiling the steel manufactured in accordance with the method of the present invention at a coiling temperature (target temperature) obtained depending on the effective amount of Ti*, super formable and high strength steels having a very high r-value can be stably manufactured.

Example 4

A steel slab shown in Table 7 below was finish hot rolled at 910° C. to obtain a hot rolled steel sheet having a thickness of 3.2 mm. After the hot rolled steel sheet was coiled under the conditions shown in Table 8, the resulting coil was cold rolled at a cold rolling reduction rate of 77%. The annealing recrystallization finish temperature and the mechanical properties of the cold rolled steel sheet were measured. The results are shown in Table 8 below.

As shown in Table 7, the content of both Si and S was 0.01%.

TABLE 7

| Steel No. | Chemical components (wt %) C | Mn | P | N | S•Al | Ti | Nb | B (ppm) | Ti* | Values calculated from Formula 4 |
|---|---|---|---|---|---|---|---|---|---|---|
| 32 | 0.0027 | 0.88 | 0.11 | 0.0025 | 0.05 | 0.024 | 0.007 | 9 | 0.015 | 607 ± 15° C. |
| 33 | 0.0031 | 0.78 | 0.102 | 0.002 | 0.27 | 0.021 | 0.013 | 8 | 0.014 | 624 ± 15° C. |

TABLE 8

| Steel No. | Target coiling temperature | Measured coiling Temperature | Size of precipitates (mean, nm) | Other properties of precipitates | r-values | Annealing recrystallization finish temperature |
|---|---|---|---|---|---|---|
| 32 | 607 ± 15° C. | 550 | 15 | Precipitates having a size of 10 nm or less were observed | 1.86 | 830 |
| | | 610 | 37 | | 2.36 | 820 |
| | | 680 | 56 | A large amount of FeTiP was observed | 1.98 | 820 |
| 33 | 624 ± 15° C. | 550 | 23 | | 1.96 | 810 |
| | | 620 | 42 | | 2.43 | 790 |
| | | 700 | 62 | A large amount of FeTiP was observed | 2.05 | 790 |

As shown in Table 8, when the sheet was coiled at a low temperature relative to the target coiling temperature, ultrafine precipitates were observed. The presence of the ultrafine precipitates lowered the r-value and increased the annealing recrystallization finish temperature. Too high coiling temperature resulted in the formation of a large amount of FeTiP in the steel, a cause of low r-value. FeTiP was decomposed during annealing, and impeded the development of the recrystallized texture. When the S. Al content was high as in steel No. 33, precipitates were stably formed (slightly increased in size) and thus the workability was improved and the annealing recrystallization temperature was lowered.

As is apparent from the above description, the thin steel sheet according to the present invention exhibits excellent workability, low-temperature annealing properties and excellent powdering resistance by reduced distribution of the Ti-based precipitates, etc. and coarse size of the precipitates.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method for manufacturing a super formable high strength thin steel sheet, comprising the steps of:

finish hot rolling a steel slab having a composition of 0.010 wt % or less of C, 0.02 wt % or less of Si, 1.5 wt % or less of Mn, 0.03-0.15 wt % or less of P, 0.02 wt % or less of S, 0.21-0.40 wt % of Sol. Al, 0.004 wt % or less of N, 0.005-0.040 wt % of Ti, 0.002-0.020 wt % of Nb, one or both of 0.0001-0.02 wt % of B and 0.005-0.02 wt % of Mo, and the balance Fe and inevitable impurities at the austenite monophase zone, wherein the components P, Mn, Ti, Nb and B satisfy the relationship represented by the following Formulae 1-1 and 1-2, depending on a selected tensile strength:

at tensile strength of 35 kg and 40 kg grades $$29.1+89.4P(\%)+3.9Mn(\%)-133.8Ti(\%)+157.5Nb(\%)+0.18[B(ppm)\text{ or }Mo(\%)]=35-44.9 \quad \text{Formula 1-1, and}$$

at tensile strength of 45 kg grade $$29.1+98.3P(\%)+4.6Mn(\%)-86.5Ti(\%)+62.5Nb(\%)+0.21[B(ppm)\text{ or }Mo(\%)]=45-50 \quad \text{Formula 1-2, and}$$

wherein the components Ti, N, C and Nb satisfy the relationship represented by the following Formulae 2 and 3:

$$0.6 \leqq (1/0.65)(Ti-3.43N)/4C \leqq 3.5 \quad \text{Formula 2, and}$$

$$0.4 \leqq (1/0.35)(Nb/7.75C) \leqq 2.2 \quad \text{Formula 3, and}$$

coiling the resulting steel slab at a temperature meeting the following condition: $730\sqrt{(1-(Ti^*/0.027)^2)}\pm15°$ C. [in which $Ti^*=Ti(\%)-3.43N(\%)$];

cold rolling the coil; and continuously annealing the cold rolled coil at 780-830° C.

* * * * *